United States Patent [19]

Arpino

[11] 4,041,831

[45] Aug. 16, 1977

[54] INSTRUMENT FOR TUNING MUSICAL INSTRUMENTS

[76] Inventor: Ronald G. Arpino, 24 Damien Road, Branford, Conn. 06405

[21] Appl. No.: 594,114

[22] Filed: July 8, 1975

[51] Int. Cl.[2] ..... G10G 7/02

[52] U.S. Cl. ..... 84/454

[58] Field of Search ..... 84/454; 324/79 R

[56] References Cited

U.S. PATENT DOCUMENTS

| | | | |
|---|---|---|---|
| 2,924,776 | 2/1960 | Peterson | 84/454 |
| 3,144,802 | 8/1964 | Faber, Jr. et al. | 84/454 |
| 3,472,116 | 10/1969 | Schott | 84/454 |
| 3,631,756 | 1/1972 | Young | 84/454 |
| 3,795,169 | 3/1974 | Belcher | 84/454 |
| 3,881,389 | 5/1975 | Allen | 84/454 |
| 3,901,120 | 8/1975 | Youngquist | 84/454 |

*Primary Examiner*—Stephen J. Tomsky
*Attorney, Agent, or Firm*—DeLio and Montgomery

[57] ABSTRACT

An instrument for tuning musical instruments where a low difference frequency is derived between the instrument to be tuned and a reference frequency. The difference frequency signal is shaped to a pulse train of constant amplitude and width pulses. The pulses are integrated with respect to time, and an indicating meter indicates when the instrument is precisely in tune or small sharp or flat deviations therefrom.

14 Claims, 7 Drawing Figures

INSTRUMENT FOR TUNING MUSICAL INSTRUMENTS

This invention relates to tuning instruments and more particularly relates to an instrument which will precisely indicate very small differences in frequency from a desired frequency.

The present invention provides a system for precisely tuning a musical instrument to either one frequency or, in the case of string instruments, to a plurality of frequencies, and an indicating device which will precisely indicate when the instrument or string is in tune, and very small degrees of sharps or flats.

In a system embodying the present invention, in one form thereof, the frequency of a note to be monitored is mixed with a reference frequency of very small difference, preferably no more than 20 Hertz. Thereafter, the difference frequency is selected and passed by a low pass or band pass filter and amplified. The filter selected difference frequency is then shaped to rectangular pulses of constant height and duration. The pulses of constant height and duration are thereafter applied to a meter calibrated to show when the integrated value of the pulses indicates precise tuning. A tuning error of only 1 Hertz over a frequency of 300 Hz may result in a meter indication of a 15 to 20 percent error.

In another embodiment of the invention, two or more reference frequencies are applied to the mixer. The reference frequencies are selected such that a difference desired frequency between a reference and the frequency of a string or a harmonic thereof lie within a very small range and the meter is calibrated to indicate when all presented notes are on key.

An object of this invention is to provide a new and improved instrument for tuning musical instruments.

A further object of this invention is to provide a new and improved tuning instrument which is more precise in indicating when a musical note is sharp or flat, and when the tone is precisely on key.

A further object of this invention is to provide a tuning instrument which will enable the tuning of all strings of a multi-string instrument while utilizing only one reference frequency, and obviating the requirement of frequency selection switches.

A still further object of the invention is to provide a tuning instrument where a plurality of reference frequencies may be selectively derived from one base frequency, and each reference frequency has essentially the same difference with respect to one of the frequencies to be tuned.

The features of the invention which are believed to be novel are particularly pointed out and distinctly claimed in the concluding portion of this specification. However, the invention both as to its operation and organization, together with further objects and advantages thereof, may best be appreciated by reference to the following detailed description taken in conjunction with the drawings, wherein:

FIG. 1 is a block diagram of a network embodying the invention;

FIGS. 2*a*, 2*b*, and 2*c* are diagrams of waveforms appearing in the network;

Figure 1:
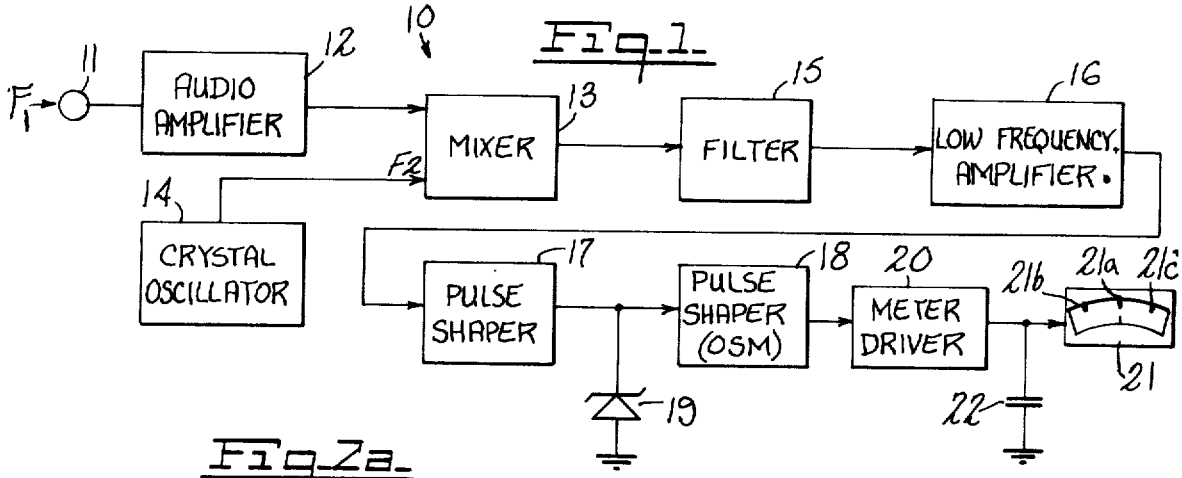

As shown in FIG. 1, a circuit 10 embodying the invention comprises a pickup 11 for a musical tone or signal to be tuned to a frequency $F_1$. The signal may be the prominent frequency of a brass or woodwind piece such as the E note at 329.63 Hz. The signal may also be from the E string of a guitar. The pickup 11 may be a microphone, telescoping jack of an electric guitar, or any other device which will receive and reproduce a given tone or frequency signal. An amplifier 12 receives the output of pickup 11, and may include an audio frequency filter having a band pass which includes the frequency or harmonic frequency of the signal to be monitored. The output of audio amplifier 12 is applied to a mixer 13 which also receives a reference frequency input $F_2$ from an oscillator 14, preferably crystal controlled for precision.

The output of the mixer will contain signals of frequency $F_1$; $F_2$; $F_1 + F_2$ and $F_2 - F_1$. A low pass filter 15 or a filter which preferably has a pass band of about three to twenty Hertz receives the output of mixer 13 and passes the signal of frequency $F_2 - F_1$ to a low frequency amplifier 16.

Figure 2A:
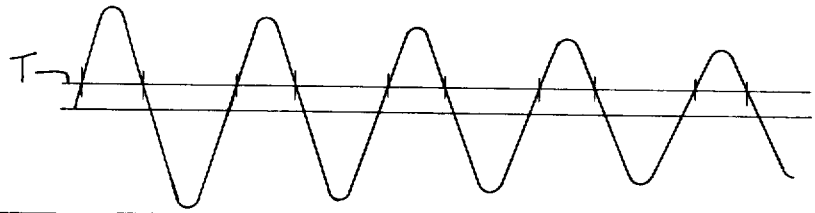
Figure 2B:
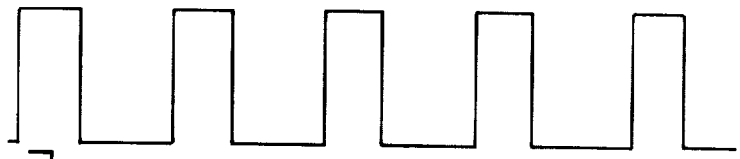
Figure 2C:
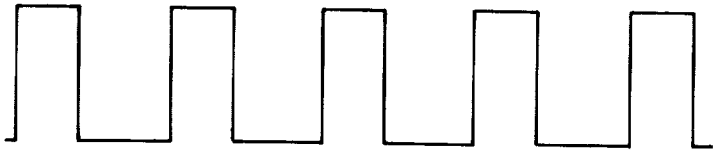

The signal having the frequency $F_2 - F_1$ from filter 15 is shown as a simple generally sinusoidally varying signal in FIG. 2*a*, and may be of varying or declining amplitude. An amplified signal of frequency $F_2 - F_1$ is applied to a pulse shaper 17 which may be of the Schmidt trigger type, and which emits a rectangular pulse so long as the input signal is above a given threshold level, T. The resultant output of pulse shaper 17 is shown in FIG. 2*b*, and comprises rectangular pulses of constant height but of varying width. The waveform of FIG. 2*b* is then applied to a second pulse shaper 18 which may be a one-shot multivibrator (OSM) which provides a pulse of constant width and height for each input pulse, as shown in FIG. 2*c*.

The shaping network may include a regulator 19, represented as a Zener diode to control the height of the pulses of waveform 2*b*. The pulses of constant height and duration (FIG. 2*c*) are applied to a metering network which includes a meter driver 20, a meter 21 and an integrating or averaging capacitor 22.

For purposes of example, assume that the instrument to be tuned is the first E string of a guitar and the desired frequency is 329.63 Hz. The frequency of crystal oscillator 4 is then selected to be 341.33 Hz and the difference frequency $F_2 - F_1$ will then be 11.7 Hz if the E string is properly tuned. Thus, the frequency of the waveform of FIG. 2*c* will at proper tuning be 11.7 Hz and meter 21 is calibrated to give an indication at marker 21*a* when this difference frequency is achieved. The indicia 21*b* and 21*c* may show certain degrees of flat or sharp indicating as little as 1 Hertz difference from the desired frequency of 329.63 Hz. For the E note, the capacitance 22 is selected, and meter 21 calibrated to read center scale when the rate of the pulses of FIG. 2*c* is 11.7 Hz.

Accordingly, the E string may be tuned with great precision. If the E string is off-key by only one Hertz this will be indicated as substantially a 10 percent error on meter 21. Thus, a discrepancy of about one one-thousandth is indicated as a discrepancy of about one-tenth or greater.

With the arrangement shown in FIG. 1 and with an oscillator 14 fixed at a frequency of 341.33 Hz, all strings on a guitar can be precisely tuned either to the fundamental or harmonic thereof by fretting.

Figure 3:
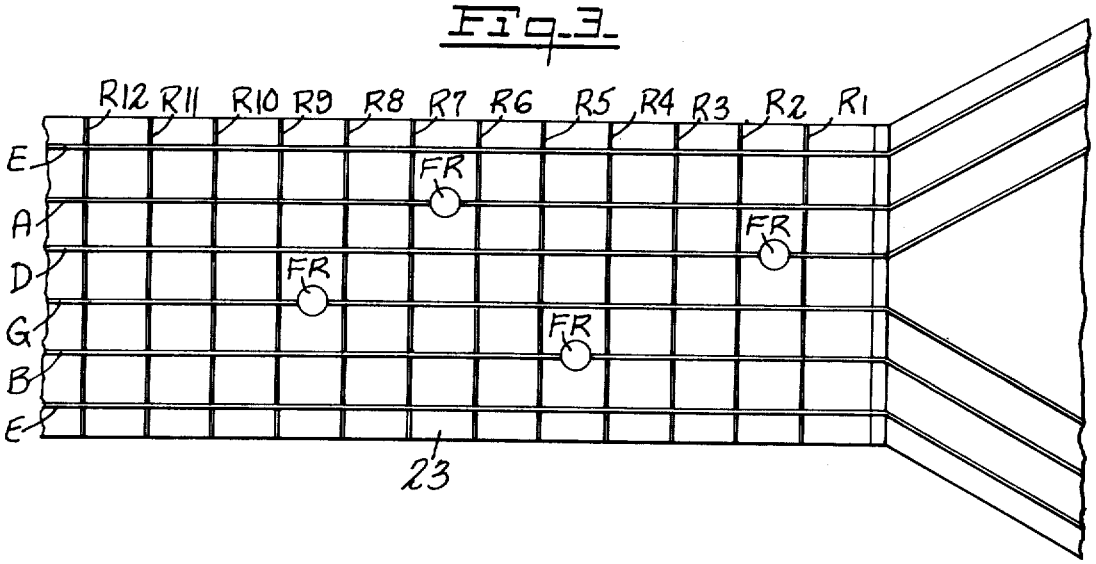
FIG. 3 is a view of a portion of the neck of a six string guitar.

FIG. 3 exemplifies a portion of the neck 23 of a guitar having E, B, G, D, A and E strings, and having frets R1 - R12 and corresponding fretting areas. The B and G strings may be fretted at fret positions R5 and R9, respectively, to give the fundamental E note. The D and A strings may be fretted at positions R2 and R7, respectively, to give the second harmonic of the lower E note and the lower E string played open as its fourth harmonic is identical to the higher E.

Accordingly, by fretting at the dots FR, indicating the fretting positions, each string of the guitar may be precisely tuned to its fundamental frequency utilizing the instrument of FIG. 1 having an oscillator frequency of 341.33 Hz. The pickup from the guitar may be by means of a telescoping jack in the event it is an electric guitar, and in the event it is not an electric, a microphone may be utilized.

The relationship of the string frequencies and fretted frequencies is shown in Table I.

TABLE I

| | Base Frequency | Fretted Frequency | of Fret | Harmonic Filtered | Final Frequency |
|---|---|---|---|---|---|
| E | 329.63 Hz | 329.63 Hz | Open | 1 | 329.63 Hz |
| B | 246.94 | 329.63 | 5 | 1 | 329.63 |
| G | 196.00 | 329.63 | 9 | 1 | 329.63 |
| D | 146.83 | 164.81 | 2 | 2 | 329.62 |
| A | 110.00 | 164.81 | 7 | 2 | 329.62 |
| E | 82.41 | 82.41 | Open | 4 | 329.64 |

In operation, the musician would first open tune the E string until the center position on meter 21 was observed. Then the musician would follow the same practice while fretting the B string at the fifth fretting position, the G string at the ninth fretting position, the D string at the second fretting position, the A string at the seventh fretting position. Alternatively, the A string could be fretted open since its third harmonic of 330 Hz is very close to the final frequency desired, and within the tuning stability of the string.

The result will be a precisely tuned instrument.

Figure 4:
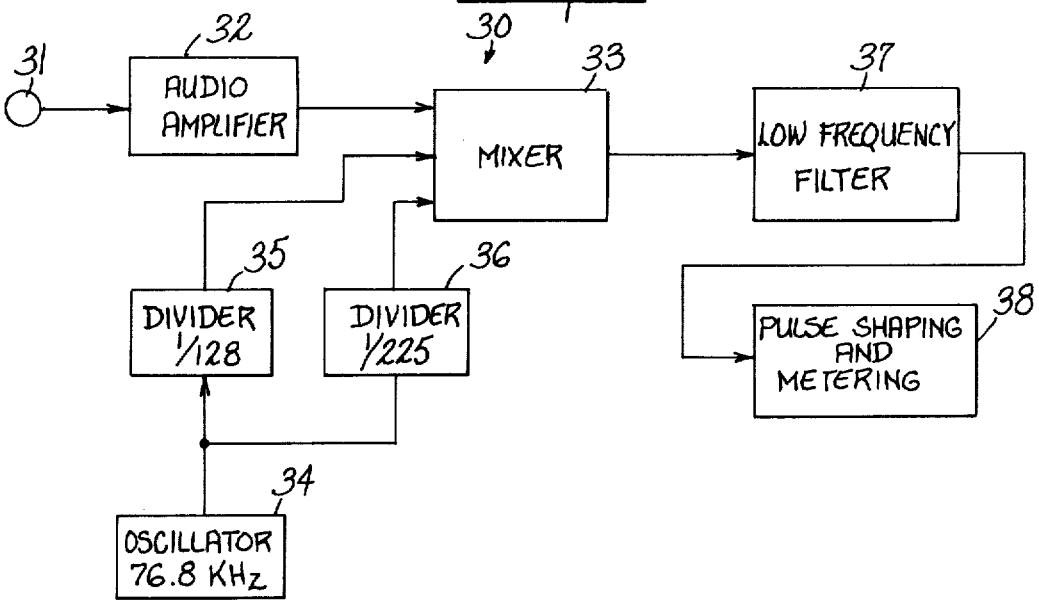
FIG. 4 is a diagram, in block form, of another embodiment of the invention.

FIG. 4 illustrates another embodiment of the invention which would enable a guitar to be tuned with open strings. Network 30 comprises a pickup 31 which may either be the jack from an electric guitar or microphone for a non-electric guitar, an audio amplifier 32, a mixer 33, oscillator 34 which provides a predetermined frequency and frequency-dividing networks 35 and 36 having predetermined divisors. The outputs of the dividers are applied to the mixer 33. The desired frequencies from mixer 33 are applied to a filter 37 and the detected frequency is then applied to a pulse-shaping and metering network 38 corresponding to the pulse shapers 17, 18, meter driver 20, and meter 21 of FIG. 1. Frequency dividers 35 and 36 divide the 76.8 kilohertz output of oscillator 34 by 128 and 225, respectively. This will provide inputs to mixer 33 of 341.33Hz and 600 Hz. The application of these signals to mixer 33 also provides a difference frequency of 258.67 Hz.

Reference is now made to Table II which shows the fundamental and some harmonics of the six strings of a guitar.

TABLE II

| | | $F_0$ | $F_2$ | $F_3$ | $F_4$ | $F_5$ |
|---|---|---|---|---|---|---|
| 1st | E | 329.63 | | | | |
| 2nd | B | 246.94 | 493.88 | | | |
| 3rd | G | 196.00 | 392.00 | 588.00 | | |
| 4th | D | 146.83 | 296.66 | 440.49 | 587.32 | |

TABLE II-continued

| | | $F_0$ | $F_2$ | $F_3$ | $F_4$ | $F_5$ |
|---|---|---|---|---|---|---|
| 5th | A | 110.00 | 220.00 | 330.00 | 440.00 | 550.00 |
| 6th | E | 82.41 | 164.82 | 247.23 | 329.64 | 412.05 |

Utilizing the three frequencies $F_1 = 258.67$ Hz $F_2 = 341.33$ Hz $F_3 = 600.00$ Hz to mix with the base frequencies and harmonics of the guitar strings as set forth in Table II, the following relations are obtained.

$E_f0 - F_2 = 11.70$ Hz $B_f0 - F_1 = 11.73$ Hz $G_{f3} - F_3 = 12.00$ Hz $D_{f4} - F_3 = 12.68$ Hz $A_{f4} - F_2 = 11.33$ Hz $E_{f4} - F_2 = 11.69$ Hz where the tuning frequency is indicated by the string designation followed by the base or harmonic frequency.

If filter 37 is selected to have a center band pass of 11.7 Hz and pulse shaping and metering network 35 is calibrated to show a center reading of 11.7 Hz, it will be noted that the maximum deviation in frequency from such center reading would be less than one cycle on the fourth harmonic of the D string. This corresponds to an error of 0.25 Hz at the fundamental, a difference that probably cannot be detected by the human ear from the strings of a guitar. This error is well within the stability of the strings when tuned.

Thus, with the arrangement shown and the filter 37 turned to select only the low difference frequencies on the order of 12 Hz as the strings are tuned, only the difference frequencies shown above and the untuned deviations therefrom will be applied to the metering network.

It will be apparent that there will be a plurality of difference frequency outputs of mixer 33. However, the selectivity of filter 37 will permit only the desired frequencies to pass.

Thus all the strings may be open tuned to a single meter indication. If desired, the meter may be calibrated to show each of the different frequencies shown. In some cases this may be desirable, but it is generally not considered to be necessary.

It will be appreciated that if desired a plurality of oscillators could be utilized as, for example, oscillator 34 and dividers 35 and 36 could be replaced by oscillators having frequencies of 320 Hz, 578.03 Hz and 484.15 Hz, in which case the filter 37 would have a band pass centered at about 9.7 Hz and the meter calibrated accordingly. With such arrangement, the maximum error would be less than 0.4 Hz.

Figure 5:
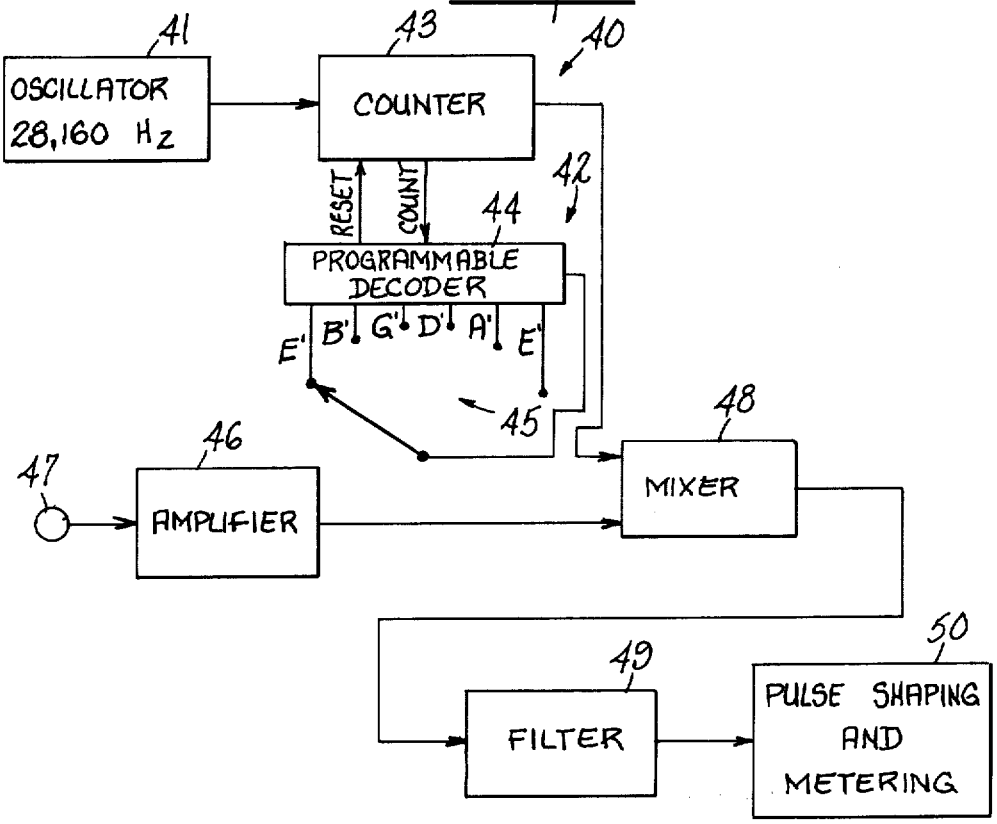
FIG. 5 is a diagram in block form of still another embodiment of the invention.

Another embodiment of the invention which utilizes a single oscillator in conjunction with a frequency divider to provide a plurality of reference signal frequencies is shown in FIG. 5. The system 40 of FIG. 5 comprises a crystall-controled oscillator 41 operating at a frequency of 28,160 Hz. The signal output of oscillator 41 is applied to a frequency divider 42 which in one form may comprise a binary counter 43 together with a programmable decoder 44 arranged to provide certain divisions of the oscillator frequency. The selector switch 45 is connectable to any of terminals E', B', G', D', A' or E' which will predetermine a counting cycle of counter 43. Decoder 44 supplies a Reset signal to counter 43 when a predetermined count has been reached. An output pulse is derived from counter 40 and applied to mixer 48 upon Reset. Thereafter, counter 40 provides an output pulse each time it is reset after a predetermined count.

The network 40 further comprises an audio amplifier 46 with pickup 47, a mixer 48, a low band pass filter 49 and a pulse shaping and metering circuit 50 as previously described. The oscillator frequency is selected so that it may be divided to give a beat frequency which differs only by a preselected amount from the tuned frequency of each string.

In this connection, reference is made to Table III which shows the tuned frequency of each string, the divisors of the greater frequency, and the resulting quotient B. The difference frequency in all cases departs from a difference frequency of 14 Hz by no more than 0.22 Hz.

TABLE III

| | $f_o$ | Divisor (D) | $28160/_D(B)$ | $f_o$ - B |
|---|---|---|---|---|
| E | 329.63 | 82 | 343.41 | 13.78 |
| B | 246.94 | 108 | 260.74 | 13.80 |
| G | 196.00 | 134 | 210.15 | 14.15 |
| D | 146.83 | 175 | 160.91 | 14.08 |
| A | 110.00 | 227 | 124.05 | 14.05 |
| E | 82.41 | 292 | 96.44 | 14.03 |

In practice, the musician will play each string against the selected position of switch 45, and observe the indicating device to determine when each string is precisely in tune.

Instruments embodying the invention may be constructed for various instruments and designed for any reasonable range of filter selectable difference frequencies.

It may thus be seen that the objects of the invention set forth as well as those made apparent from the foregoing description are efficiently attained. While preferred embodiments of the invention have been set forth for purposes of disclosure, modification to the disclosed embodiments of the invention as well as other embodiments thereof may occur to those skilled in the art. Accordingly, the appended claims are intended to cover all embodiments of the invention and modifications to the disclosed embodiments which do not depart from the spirit and scope of the invention.

What is claimed is:

1. An instrument for indicating when an audio frequency signal such as a tuned frequency of a musical instrument is achieved comprising audio-receiving means adapted to receive an audio frequency signal, a local oscillator having a signal whose frequency differs by a small amount from the tuned frequency, a mixer for mixing the received audio frequency signal and the local oscillator signal to provide a difference frequency therebetween, filtering means, said filtering means having a pass range selected to pass a narrow frequency range including said difference frequency and exclude other frequency outputs of said mixer, said filter receiving the output of said mixer, pulse-shaping means responsive to the output of said filter for converting the difference frequency signal to a series of pulses of predetermined height and width of the same frequency as said difference frequency, an indicating meter, and means for applying said pulses to said indicating meter, said meter being calibrated to indicate the frequency of said pulses, whereby the meter may indicate when the difference frequency is a predetermined value.

2. The instrument of claim 1 wherein said predetermined difference frequency is no greater than twenty Hertz.

3. The instrument of claim 1 wherein said indicating device will indicate when the audio frequency signal is at said predetermined frequency and sharp or flat therefrom.

4. An instrument for tuning a multi-string music instrument where each string has a fundamental frequency and harmonics thereof, comprising audio-receiving means adapted to receive signals from said strings, means providing a plurality of signal frequencies lesser in number than the strings of the instrument, a mixer for mixing the signal frequencies and the frequencies and harmonics of said strings, said signal frequencies selected such that a difference frequency between one of the signal frequencies and a fundamental or harmonic of one of said strings when tuned is essentially a predetermined difference frequency for all strings, a filter having a pass range selected to pass a narrow frequency range including said predetermined difference frequency and exclude other frequency outputs of said mixer, and an indicating device responsive to the output of said filter to indicate when said difference frequency is at the predetermined value.

5. The instrument of claim 4 wherein the signal frequencies are three in number and are essentially 320 Hz, 573 Hz, and 484 Hz.

6. The instrument of claim 4 further including pulse-shaping means between said filter and said indicating device for producing pulses of constant width and height in response to each amplitude cycle of said difference frequency.

7. The instrument of claim 4 wherein said signal frequency providing means is an oscillator, a plurality of frequency dividing means receiving the output of said oscillator and providing said signal frequencies.

8. The instrument of claim 4 wherein said oscillator provides a frequency output of essentially 76.8 KHz and said dividers divide by factors of 128 and 225.

9. An instrument for monitoring a plurality of frequencies comprising a mixer, means for applying one of the plurality of frequencies to said mixer, means for applying a plurality of fixed frequency signals to said mixer, said fixed frequency signals being of frequency values such that one differs no more than a predetermined number of cycles from the fundamental or a harmonic of one of said plurality of frequencies, a filter having a band pass selected to pass a narrow range of frequencies including the difference frequencies of said no more than a predetermined number of cycles, said filter receiving the output of said mixer, pulse-shaping means responsive to the output signal of said filter to provide a series of pulses of fixed height and width corresponding in frequency to the passed difference frequency, and an indicating device responsive to said pulses and calibrated to indicate selected frequency differences between one of said plurality of frequencies or a harmonic thereof and one of said fixed frequencies, all of said selected differences differing no more than 10 percent of one another.

10. An instrument for tuning a multi-string music instrument where each string has a fundamental frequency, comprising means providing a base reference frequency, frequency divider means for dividing said base reference frequency by predetermined factors to provide a plurality of reference signal frequencies, each of said signal frequencies having essentially the same predetermined frequency difference from the tuned frequency of one of said strings, a mixer for mixing said reference signal frequencies and the frequency of the strings, a filter tuned to select said predetermined frequency difference, and an indicating device responsive to the output of said filter to indicate when said difference frequency is at a selected value.

11. The instrument of claim 10 wherein said reference frequency is 28,160 Hertz.

12. The instrument of claim 11 wherein said predetermined divisor factors are 82, 108, 134, 175, 227 and 292.

13. The instrument of claim 10 further including pulse-shaping means between said filter and said indicating device for producing pulses of constant width and height in response to each amplitude cycle of said difference frequency signals.

14. A method of tuning a guitar having E, B, G, D, A and E strings and a plurality of frets for the strings comprising the steps of providing a frequency responsive instrument including an oscillator having a frequency a predetermined difference from the tuned frequency of the higher E-string, a mixer and an indicating device which indicates when the predetermined difference exists between a string frequency and the local oscillator, mixing the frequency of the string to be tuned with the frequency of the local oscillator, filtering the output of the mixer to pass only a narrow frequency range including the predetermined difference frequency, shaping the filtered output of the mixer to a series of pulses predetermined height and width having a frequency the same as the difference frequency, applying said pulses to the indicating device, fretting the guitar where necessary so that the tuned frequency or a harmonic thereof is equivalent to the tuned frequency of the higher E string, and tuning each string while observing on the indicating device when said predetermined frequency difference is achieved for each string.

* * * * *